United States Patent [19]

Bakker

[11] Patent Number: 4,764,138

[45] Date of Patent: Aug. 16, 1988

[54] METHOD OF MANUFACTURING A COLOR TELEVISION DISPLAY TUBE AND COLOR TELEVISION DISPLAY TUBE MANUFACTURED ACCORDING TO THE METHOD

[75] Inventor: Gijsbertus Bakker, Eindhoven, Netherlands

[73] Assignee: U.S. PHilips Corporation, New York, N.Y.

[21] Appl. No.: 367,536

[22] Filed: Apr. 12, 1982

Related U.S. Application Data

[63] Continuation of Ser. No. 94,609, Nov. 15, 1979, abandoned.

[30] Foreign Application Priority Data

Dec. 27, 1978 [NL] Netherlands ..... 7812543

[51] Int. Cl.[4] ..... H01J 9/26

[52] U.S. Cl. ..... 445/3; 445/45

[58] Field of Search ..... 51/283 R; 445/45, 66, 445/3

[56] References Cited

U.S. PATENT DOCUMENTS

| | | | |
|---|---|---|---|
| 3,034,778 | 5/1962 | Shaffer et al. | 269/908 |
| 3,329,422 | 7/1967 | Hajduk | 269/908 |
| 3,369,881 | 2/1968 | Bennett et al. | 445/45 |
| 3,381,347 | 5/1968 | Reinwall, Jr. | 51/283 R X |
| 3,806,108 | 4/1974 | Adachi et al. | 445/66 |
| 3,807,006 | 4/1974 | Segro et al. | 445/3 |
| 3,971,490 | 7/1976 | Conger | 445/45 |
| 4,373,237 | 2/1983 | Bakker et al. | 445/3 |

FOREIGN PATENT DOCUMENTS

| | | | |
|---|---|---|---|
| 2021994 | 12/1979 | United Kingdom | 51/283 R |

*Primary Examiner*—Kenneth J. Ramsey

*Attorney, Agent, or Firm*—Robert J. Kraus

[57] ABSTRACT

In a method of manufacturing a color television display tube, a reference system is used for adjusting the various components of the tube relative to each other.The system fixes the deflection center and the electron-optical axis of a deflection device, provided afterwards on the tube, in an early stage of the manufacturing process of the tube. The adjustment of the components is carried out while being referred to the fixed deflection center or the fixed electron-optical axis. The method simplifies the subsequent positioning of the deflection device on the tube.

1 Claim, 2 Drawing Sheets

METHOD OF MANUFACTURING A COLOR TELEVISION DISPLAY TUBE AND COLOR TELEVISION DISPLAY TUBE MANUFACTURED ACCORDING TO THE METHOD

This application is a continuation of application Ser. No. 094,609, filed Nov. 15, 1979, now abandoned.

BACKGROUND OF THE INVENTION

The invention relates to a method of manufacturing a colour television display tube comprising a neck, a funnel, a display window and an electron gun mounted in the neck to generate three electron beams, said components of the tube being adjusted relative to each other while using a reference system.

The invention furthermore relates to a colour television display tube manufactured according to this method.

In the manufacture of colour television display tubes it is usual to remove colour impurities and convergence errors of the tube with the aid of a number of correction means. These colour impurities and convergence errors are a result of inaccurate adjustment of the various components relative to each other, during assembly of the tube.

Moreover, because of limitations in the accuracy with which the components themselves can be manufactured, the same components are not identical to each other.

For the adjustment of the various components of the tube, various reference systems are known. A typical reference system is disclosed in U.S. Pat. No. 3,971,490. In accordance with this patent, reference surfaces are ground on the funnel portion of the tube, the axis of the neck of the funnel portion being referred to the ground reference surfaces. The display window at the circumference thereof comprises reference points with respect to which the display screen is provided on the display window. The display window is positioned on the funnel portion, the reference points of the display screen and the reference surfaces of the funnel portion being referred to a common reference R. In this manner the display screen is referred to the axis of the neck of the funnel portion. It is assumed that the effective source of the electron beams generated by an electron gun to be provided afterwards in the neck is situated on the axis of the neck so that this effective source is also referred to the display screen. When such a reference system is used, however, it is necessary for the supporting surface of the funnel portion destined for the display window to be perpendicular to the axis of the neck. In practice, it proves almost impossible to grind the supporting surface perpendicular to the axis with the required accuracy. Furthermore, when said reference system is used, individual positioning of the deflection device is necessary to position the deflection centre of the deflection device on the axis of the neck of the tube, The adjustment of the deflection device on the funnel portion is a time-consuming and costly step in the production process. Hence there exists a need for a system which minimizes the number of operations and adjustments for the positioning of a deflection device on the funnel portion of a display tube.

SUMMARY OF THE INVENTION

It is the object of the invention to provide a method for manufacturing a colour television display tube which enables positioning of a deflection device on the funnel portion of the tube within admissible tolerances by means of a few simple operations.

In accordance with the invention, a method is provided for manufacturing a colour television display tube comprising a neck, a funnel, a display window and an electron gun mounted in the neck to generate three electron beams, wherein said components of the tube are adjusted relative to each other while using a reference system. The invention is characterized in that for adjusting at least two of said components, a reference system is used which fixes a reference point to which reference is made for adjusting the components, said reference point being situated in or substantially in the deflection centre of a deflection device provided afterwards on the manufactured tube.

Deflection centre is to be understood to mean herein the centre in which, for an imaginary electron beam whose centre line coincides with the longitudinal axis (electron-optical axis) of the deflection device, the deflecting action of the field of the deflection device can be considered to be concentrated. The deflection centre is a collection of points, termed deflection points, from which, viewed from the display screen, the electrons apparently emerge. The deflection centre is synonymous with what was previously called the effective source of the electron beams.

The manufacture of a deflection device can be done with small tolerances. This means that the location of the deflection centre relative to defined points of the device is accurately fixed. By choosing, the location of the deflection centre in the tube as a reference point, during the manufacture of the display tube, and adjusting the various components such as display window, funnel, neck and electron gun by referring to the location of this reference point, the deflection centre of a deflection device provided afterwards on the display tube coincides with the reference point determined by the reference system. A reference system is used which also fixes a reference axis which at least substantially coincides with the electron-optical axis of the deflection device provided afterwards on the manufactured tube. By manufacturing the tube in the above-described manner, the location of the deflection centre is known at an early stage of the manufacturing process of the tube.

According to one embodiment of the invention, the reference system is mainly determined by a centring unit which fixes the funnel and determines the deflection centre in the funnel. In another embodiment of the invention, the reference system is determined by a centring unit which fixes the funnel and determines the deflection centre and the electron-optical axis in the funnel.

In still another embodiment, the reference system is determined by a centring unit which fixes the funnel and in the funnel determines the deflection centre, the electron-optical axis and a system of main axes with its origin in the deflection centre and the directions of the two main axes substantially parallel to the rectangular sides of the substantially rectangular end of the funnel.

In yet another embodiment of the invention, the uniformity in the manufacturing process of the tube is increased by, in at least two steps in the manufacturing process wherein a component of the tube is adjusted relative to the funnel, using a centring unit which fixes the funnel in an identical manner.

If, for adjusting the components, marks are provided on the funnel, relative to which marks one or more of the other components are adjusted, the marks are referred to the deflection centre fixed by the reference system.

According to one form of the invention, a method in which the neck is secured to the funnel is characterized in that the funnel is fixed by means of the centring unit and the longitudinal axis of the neck is aligned with the electron-optical axis determined by means of the centring unit.

According to another form of the invention, a method in which an electron gun is assembled in the neck is characterized in that the funnel is fixed by means of the centring unit and the longitudinal axis of the electron gun is aligned with the electron-optical axis determined by means of the centring unit. The rotational position of the gun about its longitudinal axis can be determined by the centring unit.

In yet another form of the invention, a method in which a display window is secured to a funnel is characterised in that the funnel is fixed by means of the centring unit and the display window is secured to the rectangular end of the funnel in such manner that the two main axes of the substantially rectangular display window are substantially parallel to the directions of the corresponding main axes of the system of main axes determined by mean of the centring unit. A line through the point of intersection of the main axes of the display window, and perpendicular to the plane fixed thereby, passes substantially through the deflection centre determined by means of the centring unit.

Thus the basic idea underlying the invention is that the deflection centre and, if necessary, the electron-optical axis of the deflection device later mounted on the tube are fixed in an early stage of the manufacturing process of the tube. The positioning of the deflection device on the finished tube is thus considerably simplified. When the centering unit with which the funnel is fixed consists of a dummy deflection device, the positioning of the deflection device simply requires sliding the deflection device on the tube until it bears on the conical portion of the funnel.

BRIEF DESCRIPTION OF THE DRAWING

The invention will now be described in greater detail, by way of example, with reference to a drawing, in which.

DESCRIPTION OF THE PREFERRED EMBODIMENT

Figure 1A:
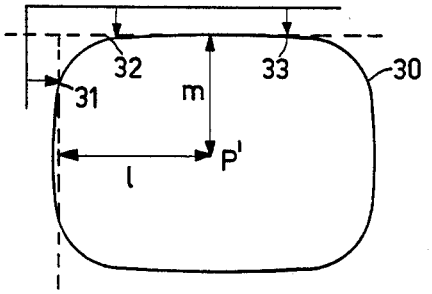
FIGS. 1(*a*) and 1(*b*) are a diagrammatic plan view and a side elevation, respectively, of the provision of a display screen on a display window by means of an exposure table.

As shown in FIG. 1(*a*) the display window is laid on an exposure table (not shown) against three abutment points 31, 32 and 33. Relative to the points 31, 32 and 33 a longitudinal window axis is defined by a line through the exposure point P′ and perpendicularly to the plane in which the points 31, 32 and 33 lie (that is the plane of the drawing). Furthermore a system of main axes of the window is defined as having its origin on the longitudinal window axis, with one axis being parallel to the line through the points 32 and 33 and one axis being perpendicular to said line. The system of main axes is parallel to the plane of the drawing. The longitudinal window axis is denoted by P′M′ in FIG. 1(*b*). The distance from point 31 to a plane through P′ perpendicular to the plane of the drawing in FIG. 1(*b*) and parallel to the main axis direction corresponding to a short side of the window 30 is denoted by 1. The distance from point P′ to a plane through the points 32 and 33 perpendicular to the plane of the drawing in FIG. 1(*a*) and parallel to the main axis direction corresponding to a long side of the window 30 is denoted by m. For clarity, the process will be described for providing the green phosphor regions on the window, with point P′ being the exposure point for the green phosphor regions of the display screen. There are two more exposure points for the red and blue phosphor regions, respectively. These points are situated very close to point P′ and together constitute an exposure centre corresponding to the deflection centre of the deflection device provided afterwards on the display tube. Furthermore the invention will be explained with reference to a display tube in which the phosphor regions are provided in the form of phosphor lines extending parallel to the short sides of the display window. These starting points for explaining the invention do not involve any restriction of the applicability of the invention. The invention may be used for any pattern of phosphor regions and the simplification introduced are not intended to limit the scope of the invention. As shown in FIG. 1(*b*) the display window having provided thereon a phosphor layer is exposed from point P′ via the shadow mask 34, point P′ being situated at a distance r from the supporting surface 35 of the exposure table. For correct positioning of the display window on the funnel portion of the tube it is sufficient for the point P′ to correspond to a point in the tube which is substantially situated in the deflection centre of the deflection device.

Figure 1B:
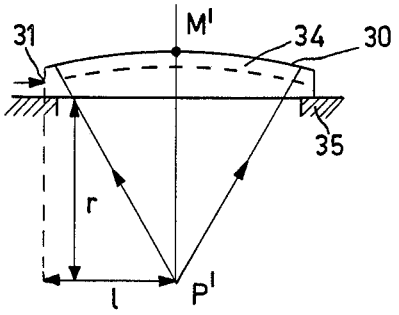
Figure 2:
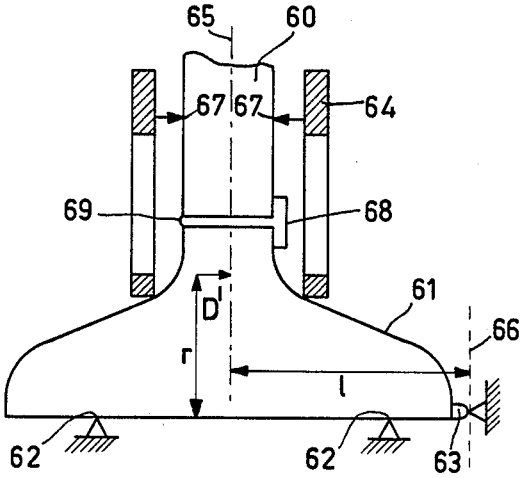
FIG. 2 shows a first embodiment of the invention in which a neck is secured to a funnel.

In FIG. 2 a neck 60 is sealed to a funnel 61. The funnel 61 is supported in points 62 and has studs of which one stud 63 on the short side of the rectangular end of the funnel is shown. A centring unit 64, placed on the conical portion of the funnel fixes the deflection centre D′ as well as the electron-optical axis 65. The centring unit is moved over the conical surface until the distance from D′ to a plane 66 is equal to the distance 1 shown in FIGS. 1*a* and 1*b*. Plane 66 is perpendicular to the plane of the drawing and parallel to the main axis direction corresponding to the short side of the rectangular end of the funnel. Once the inserted in the centring unit 64, the neck 60 is fixed on the outside by three abutments 67 which determine a point of the electron-optical axis 65. By means of a jig 68, which determines a second point of the electron-optical axis, the axis of the neck 60 is moved until it coincides with the axis 65. In this position the neck 60 and the conical portion 61 are fixed by a fixing device (not shown). The centring unit 64 and the jig 68 are removed and the neck 60 is sealed to the conical portion of funnel 61. It is also possible to fix the neck at the points 67 and to match the outer circumference of the neck as closely as possible to the outer circumference of the conical portion at the sealing seam 69. If this technique is used, the axis of the neck will not generally coincide with the axis 65. This defect is corrected, however, during insertion of the electron gun into the neck by causing the axis of the gun to coincide with the axis 65. After sealing the neck 60 the resulting funnel portion is ground to length and again placed in a centring unit corresponding to the centring unit 64. Material is ground away from the rectangular end of the funnel portion until the distance from the point D' to the ground surface is equal to the distance r shown in FIG. 1*b*.

Figure 3:
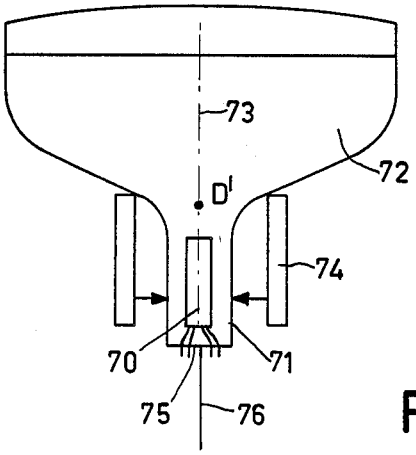
FIG. 3 shows a second embodiment of the invention in which an electron gun is assembled in the neck.

FIG. 3 shows the mounting of an electron gun 70 in the neck 71 of a funnel part 72. A centring unit 74 is again placed on the conical portion of the funnel part 72 and fixes the funnel part relative to the electron-optical axis 73 and the deflection centre D' situated therein. The gun 70 is provided on a sealing pin 75, the stem 76 of which coincides with the elongation of the axis of the gun 70. The stem 76 is moved until it coincides with the axis 73, after which the gun is sealed.

Figure 4:
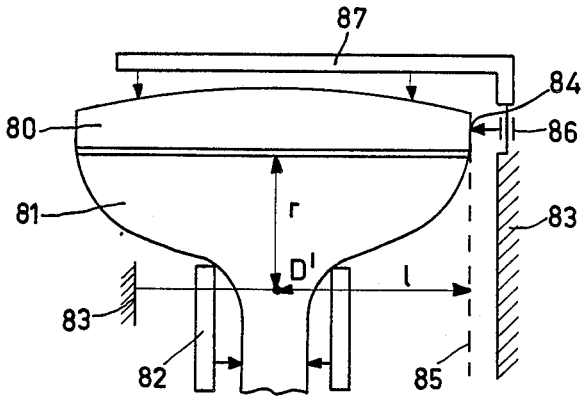
FIG. 4 shows a third embodiment of the invention in which a display window is secured to the funnel.

FIG. 4 shows the connection of a display window 80 to a funnel part 81. A centring unit 82 is used which determines the deflection centre D', the electron optical axis and a system of main axes with its origin in D', the main axes direction being substantially parallel to the main axes directions of the rectangular end of the funnel part 81. The centring unit 82 is suspended in a frame 83 so as to be rotatable about an axis perpendicular to the plane of the drawing. The funnel part 81 is fixed by the centring unit 82. The window 80, provided with a display screen in accordance with FIGS. 1*a* and 1*b*, is fixed at points 84 corresponding to the points 31, 32 and 33 of FIG. 1*a*. The distance from D' to a plane 85 corresponds to the distance 1 (FIG. 1*a*). Plane 85 passes through point 84 parallel to the short sides of the window and perpendicular to the plane of the drawing. The window 80 is then urged against the rectangular end of the funnel part 81 by lowering the pressure jig 87 by means of the guide 86. The longitudinal window axis is brought through the point D' and the main axes of the window 80 are brought parallel to the corresponding main axes of the system of main axes determined by means of the centring unit 82. Since the centring unit 82 is rotatable about D', the rectangular end of the funnel part 81 will point towards the rectangular sealing edge of the window 80. In this position the window 80 is secured to the funnel part 81.

Figure 5:
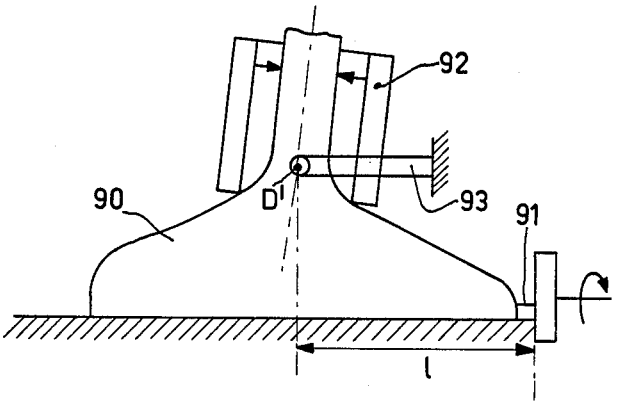
FIG. 5 shows a fourth embodiment of the invention in which marks are provided on the funnel so as to enable positioning of other components of the tube.

It is also possible to provide the funnel with marks for use in adjusting the components. As shown in FIG. 5, a funnel 90 has studs of which one stud 91 is shown on the short side of the rectangular end of the funnel. The funnel 90 is fixed by a centring unit 92 which is suspended in a frame 93 so as to be rotatable about an axis perpendicular to the plane of the drawing. The stud 91 is ground until the distance from the ground surface to a plane through D' is equal to the distance 1 (FIG. 1*a*). This plane is parallel to the short rectangular side and perpendicular to the plane of the drawing. Similarly, studs on a long rectangular side are ground so that the distance from D' to a plane through the ground studs and parallel to the plane of the drawing is equal to the distance m (FIG. 1*a*). When the positioning of the window is referred to the studs thus ground, the longitudinal axis of the window passes through the point D'.

In the embodiments described with reference to FIGS. 4 and 5, the centring units 82 and 92, respectively, may alternatively be suspended cardanically around the point D', which is necessary for display screens with hexagonally configured phosphor regions.

What is claimed is:

1. A method for establishing the relative positions of a funnel and at least one other component of a color television display tube during assembly of the components, each including a centrally located axis which must pass through a deflection center defined by a deflection device mounted on the tube after assembly of the components, said method comprising the steps of:

(a) attaching a centering device to the funnel at the location where the deflection device will be subsequently mounted, said centering device being suspended in a frame for determining the location of a reference point coinciding with the deflection center and being suspended in the frame so as to be rotatable about at least one axis passing through the reference point, said frame including means for receiving another one of the components for determining the location of the centrally located axis of said other component; and (b) positioning another one of the components relative to the funnel such that the centrally located axis thereof passes through the reference point.

* * * * *